US007043799B2

(12) United States Patent
Moody

(10) Patent No.: US 7,043,799 B2
(45) **Date of Patent: *May 16, 2006**

(54) SANITARY DOOR OPENER

(76) Inventor: Charles Moody, 751 Kentland Dr., Great Falls, VA (US) 22066

( * ) Notice: Subject to any disclaimer, the term of this patent is extended or adjusted under 35 U.S.C. 154(b) by 0 days.

This patent is subject to a terminal disclaimer.

(21) Appl. No.: 10/602,864

(22) Filed: Jun. 25, 2003

(65) Prior Publication Data

US 2004/0261226 A1 Dec. 30, 2004

(51) Int. Cl.
*E05B 1/00* (2006.01)
*A45C 13/22* (2006.01)

(52) U.S. Cl. ..... 16/412; 16/413; 16/901

(58) Field of Classification Search ..... 16/413, 16/412, DIG. 2, 402, 82, 83; D8/300, 307, D8/314, DIG. 1; 292/288, 289
See application file for complete search history.

(56) References Cited

U.S. PATENT DOCUMENTS

| | | | | | |
|---|---|---|---|---|---|
| 642,661 | A | | 2/1900 | Adams | |
| 842,081 | A | | 1/1907 | Clark | |
| 1,245,216 | A | * | 11/1917 | Gohlke | 294/26 |
| 1,337,384 | A | | 4/1920 | Allen | |
| 2,447,389 | A | * | 8/1948 | Borchers | 16/413 |
| 3,391,674 | A | | 7/1968 | Burleigh | |
| 3,509,592 | A | * | 5/1970 | Schrock | 16/412 |
| 3,514,904 | A | * | 6/1970 | Riegelman | 49/460 |
| 3,536,287 | A | * | 10/1970 | Kramer | 248/301 |
| 4,068,872 | A | * | 1/1978 | Smith | 292/87 |
| 4,116,434 | A | * | 9/1978 | Bernstein | 482/140 |
| 4,198,088 | A | * | 4/1980 | Tochihara | 292/288 |
| 4,591,148 | A | * | 5/1986 | Slater | 482/140 |
| D296,189 | S | * | 6/1988 | Marx | D8/400 |
| 4,817,239 | A | | 4/1989 | Campbell et al. | |
| 5,323,511 | A | * | 6/1994 | Gray | 16/422 |
| 5,638,906 | A | * | 6/1997 | McCabe | 169/51 |
| 6,189,183 | B1 | * | 2/2001 | Hartselle, III | 16/412 |
| 6,289,557 | B1 | | 9/2001 | Manson et al. | |
| 6,378,917 | B1 | * | 4/2002 | Jones | 292/42 |

FOREIGN PATENT DOCUMENTS

| | | | |
|---|---|---|---|
| DE | 3420675 | A1 * | 1/1985 |
| JP | 10201656 | A * | 8/1998 |
| JP | 2004100394 | A * | 4/2004 |

* cited by examiner

*Primary Examiner*—Chuck Y. Mah
(74) *Attorney, Agent, or Firm*—Peter A. Borsari

(57) ABSTRACT

A sanitary door opener in the form of an attachment to the bottom of a conventional door enables a user to pull open the door by engaging the attachment with his/her foot or shoe, thereby preventing hand contact with the door opener. The sanitary door opener preferably is manufactured from a single piece of durable and flexible metal material and is bent to form a front face, a bottom face, a rear face, a top face extending outwardly from the rear face, and a lip extending downwardly from the top face. The door opener is installed easily to a door by sliding the door opener under a door such that the front face contacts the front panel of the door, the bottom face contacts the bottom edge of the door and the rear face contacts the rear panel of the door. Once installed in the desired position, the door opener is secured to the door by mounting the front face to the door's front panel and the rear face to the door's rear panel.

9 Claims, 2 Drawing Sheets

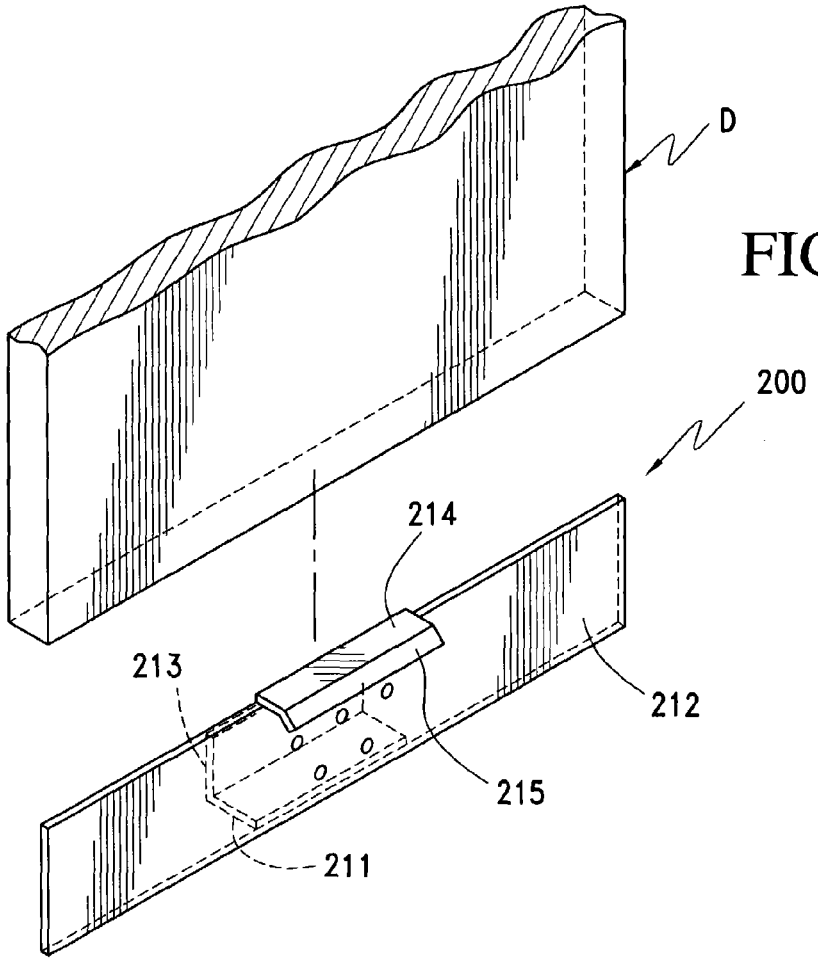
FIG. 4
FIG. 5
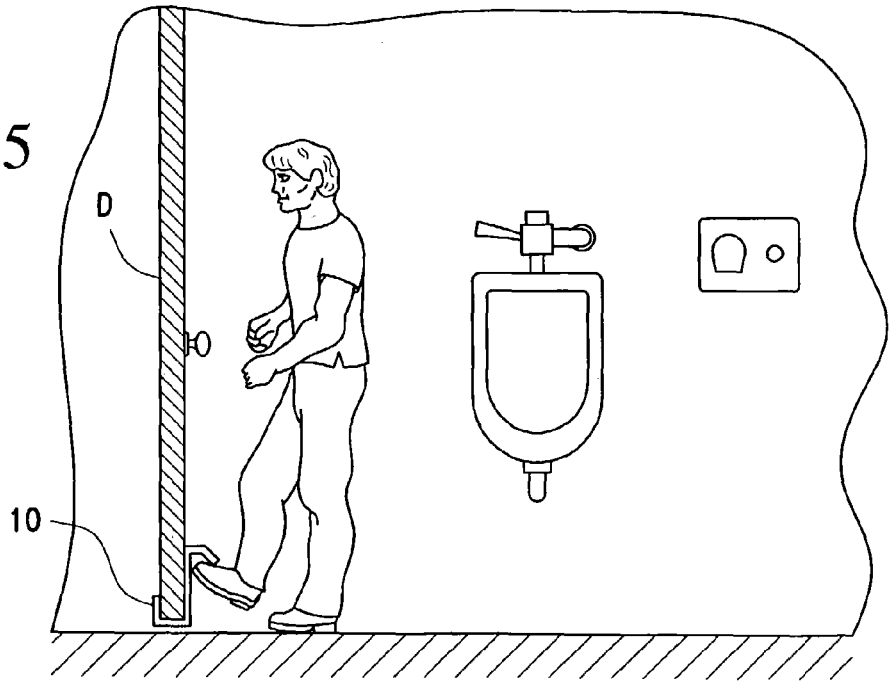

SANITARY DOOR OPENER

FIELD OF INVENTION

The present invention relates to a sanitary door opener and in particular relates to an attachment for a conventional door which enables a user to pull open the door by engaging the attachment with his/her foot.

BACKGROUND OF THE INVENTION

Hand-operated devices, such as door knobs, handles and hand pulls, are well known in the prior art for opening doors. Although these devices are easy to use, they are susceptible to unsanitary conditions due to contamination by many substances, including harmful bacteria and other germs. Once contaminated, usually by transfer from people's hands, these hand-operated devices become a perfect vehicle for transmitting harmful contaminants to other people by hand contact. Typically, most unsanitary door openers are found in public places, such as public restrooms.

Several attempts have been made in the prior art to develop sanitary door handles. For example, U.S. Pat. No. 4,817,239 to Campbell et al., issued Apr. 4, 1989, provides a sanitary door opening assembly in the form of a U-shaped bracket which is disposed about the outer side edge of a door and a hook mounted to one surface of the bracket. The hook is adapted to receive a human forearm to pull the door open. In U.S. Pat. No. 6,289,557 to Manson et al., issued Sep. 18, 2001, another sanitary door handle assembly is disclosed, also having a hook-like handle which is mounted to the face of the door such that the forearm of a person can engage the hook like handle in order to open the door. One disadvantage of such door hooks is that pulling open a door with one's elbow can cause discomfort. Further, the position of such a door hook allows a person to grab the door hook with his/her hand, thereby contaminating the door hook. Once contaminated, a person can transfer contaminants to his/her body, particularly when the elbow or forearm is not covered by clothing.

A less elaborate door opener mounted to the side of a door is disclosed in U.S. Pat. No. 3,391,674 to Burleigh, issued Jul. 9, 1968. Burleigh provides an animal operated door opening device in the form of a Z-bent sheet metal plate having a central portion, an outer lateral panel and an inner securement flange which is mounted to the side of a door at a position where an animal's snout can contact the lower free comer of the outer lateral panel. The same drawbacks discussed with respect to the Campbell and Manson patents are found in Burleigh's animal-operated door opener.

Door openers which do not utilize a person's hand or arm have been described in the prior art. For example, U.S. Pat. No. 642,661 to Adams, issued Feb. 6, 1900, U.S. Pat. No. 842,081 to Clark, issued Jan. 22, 1907 and U.S. Pat. No. 1,337,384 to Allen, issued Apr. 20, 1920 to Allen, all disclose simple hooks screw-mounted to the bottom of a screen door which allow the door to be opened by a person's foot. An inherent defect in these door openers is that they are capable only of opening light-weight doors. The screw mounted hooks are not of sufficient strength to open heavy doors, such as public bathroom doors. In addition, such simple hooks do not allow an adult foot to sufficiently engage the hook to open a heavier styled door.

Despite the efforts of the prior art, a need still exists for a sanitary door opener which can be operated without contact by a person's hand or arm. Such a sanitary door opener should be adapted for operation by a person's foot. In addition, such a sanitary door opener should be designed to flex and create tension between the user's shoe and the opener. Moreover, such a sanitary door opener should be of sufficient strength to open all types of doors, including heavy doors such as public restroom doors. Further, such a sanitary door opener should be inexpensive to manufacture, simple to install and easy to use.

SUMMARY OF THE INVENTION

Accordingly, it is an object of the present invention to provide a sanitary door opener which is operated by a person's foot, preferably a foot inside a shoe.

It is another object of the present invention to provide a sanitary door opener which does not operate by contact with a person's hand or arm.

It is an additional object of the present invention to provide a sanitary door opener which can be installed on all types of doors.

It is a further object of the present invention to provide a sanitary door opener which is sufficient strength to open heavy doors including public restroom doors.

It is also an object of the present invention to provide a sanitary door opener which is designed to flex and create tension between the user's shoe and the opener.

It is yet another object of the present invention to provide a sanitary door opener which is inexpensive to manufacture, simple to install and easy to use.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein:

FIG. 4 is a side perspective view of a second alternate embodiment of the present invention wherein the sanitary door opener is incorporated into a kick-plate design, FIG. 5 is a side view of a the sanitary door opener of the present invention installed on a restroom door.

DETAILED DESCRIPTION

Figure 1:
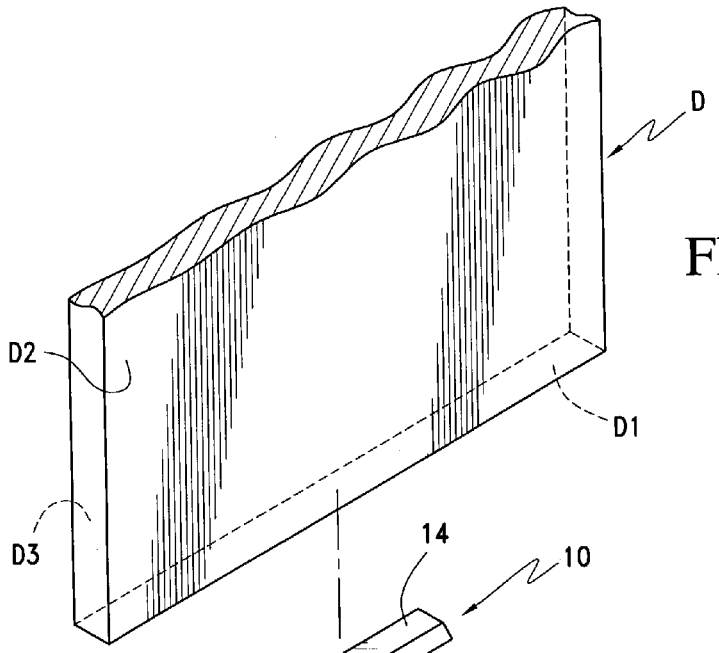
FIG. 1 is an exploded view of the bottom of a door and the sanitary door opener of the present invention.
Figure 2:
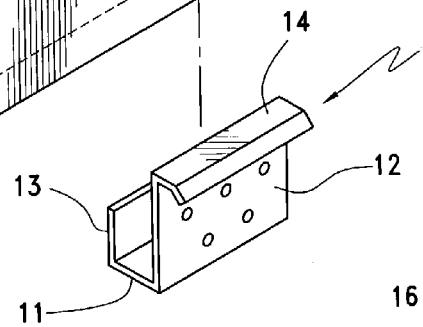
FIG. 2 is a side perspective view of the sanitary door opener of the present invention.

The present invention relates to a sanitary door opener adapted to be installed on the bottom of a door in such a manner that a person can use his/her foot to pull the door open. Referring to FIGS. 1 and 2, a door D is shown having a bottom edge D1, a rear panel D2 and a front panel D3. Also shown is the sanitary door opener 10 of the present invention, comprising a bottom face 11, a rear face 12, a front face 13 and a top face 14 extending outwardly and at a 90° angle or less from rear face 12. The depth of bottom face 11 is configured to complement the bottom edge D1 of door D. Preferably, the depth of bottom face 11 is about 1⅝" which is the standard depth of a conventional door. However, it is to be understood that the depth of the bottom face 11 can vary depending on the depth of the door. In this manner, the sanitary door opener 10 can be slid under an opened door such that rear face 12 contacts the door's rear panel D2, front face 13 contacts the door's front panel D3 and bottom face 11 contacts the bottom edge D1 of the door. Once the sanitary door opener 10 is disposed in the desired position, it can be mounted to the door D by a variety of means as will be well known to those skilled in the art. Preferably, apertures 16 are provided in rear face 12 and front face 13 such that the door opener can be screw-mounted to the door. It also is contemplated that the sanitary door opener can be secured to the door by adhesive or a combination of screw mounting and adhesive. Mounting the sanitary door opener to both the front and rear panels of the door ensures that the door opener is securely mounted to the door and will not become disengaged with the door due to extended use or wear and tear.

The sanitary door opener 10 of the present invention is composed of a strong and durable material which has some flexing ability. Preferably, the sanitary door opener is manufactured from a metal material. More preferably, the sanitary door opener is manufactured from brass or stainless steel. The sanitary door opener of the present preferably is manufactured from a single piece of material and is bent to form the several faces. However, it is to be understood that the sanitary door opener can be manufactured from more than a single piece of material without deviating from the present invention.

Both the rear face 12 and front face 13 of the sanitary door opener can be configured of any desired width provided, of course, that desired width is not greater than the width of the front and rear panels of the door. Preferably, the width of both the rear face and the front face of the sanitary door opener is between about six inches (6") and about twelve inches (12"), and more preferably about eight inches (8"). The height of the rear face 12 should be configured in such a manner that a person can engage the top face 14 with his/her shoe with ease and comfort. Preferably, the height of the rear panel is between about four inches (4") and about eight inches (8"), more preferably between about five inches (5") and about six inches (6"), and most preferably about five and one-half inches (5½") which is a height adapted to accommodate the average person. The front face 13 can be of the same height as the rear face 12 or can be of less height. Preferably, the front face is about two inches less (2") than the rear face, but should be no less than three inches (3") in order to ensure secure mounting to the front panel D2.

Referring in particular to FIG. 2, in a preferred embodiment, top face 14 extends outwardly at about a 90° angle from the rear face 12 and is configured with a depth of between about two inches (2") and about four inches (4"), preferably about three inches (3"). The top face can be provided with a lip 15 which extends downwardly from the top face 14 at about a 45° angle. The incorporation of the lip 15 enhances the engagement of the user's shoe with the sanitary door opener and aids in opening the door with the shoe. In addition, the extended top face and lip arrangement provide the sanitary door opener with a flexing ability to enhance the shoe's grip. The surface of both the top face 14 and lip 15 preferably are provided with a gripping material, including for example rubber or rubber-like material, in order to prevent the shoe from sliding. The gripping material may be applied to the surface of the top face and lip by means well known in the art, including coating, adhesive means or a plurality of screws that are recessed into the gripping material (thereby preventing the possibility of the user's shoe becoming scratched or caught on the screws). In addition to preventing the shoe from sliding, the rubber material also provides a cushioning effect if the door is opened onto the users foot or shin while the user is in the process of opening the door using the sanitary door opener of the present invention.

Figure 3:
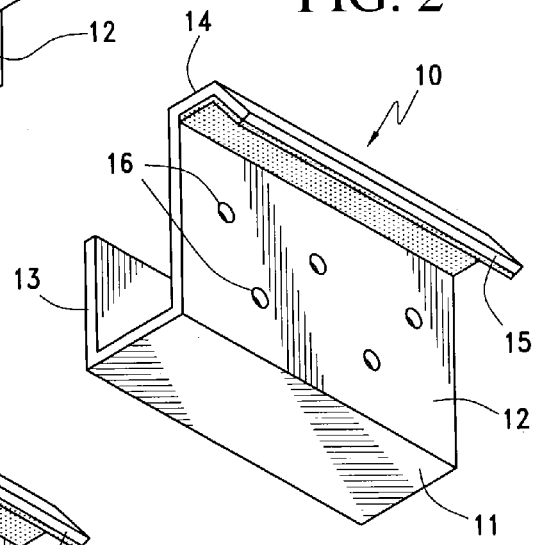
FIG. 3 is a side perspective view of an alternate embodiment of the present invention wherein the sanitary door opener is adjustable.
Figure 3:
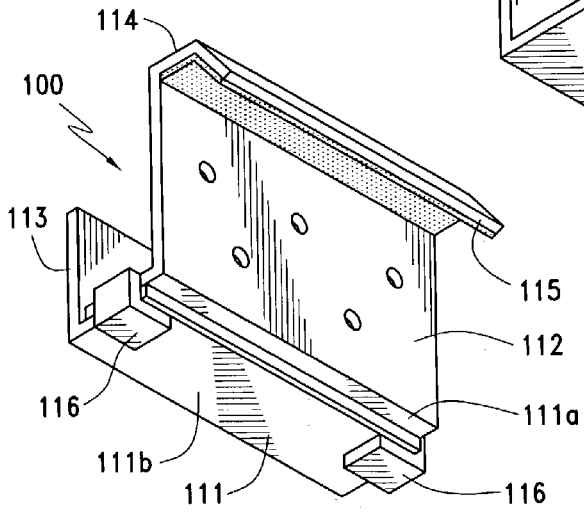

In an alternate embodiment of the present invention, the depth of the sanitary door opener is adjustable. Referring now to FIG. 3, the sanitary door opener 100 comprises a bottom face 111 having a first portion 111*a* which is joined to rear face 112 and a second portion 111*b* which is joined to front face 113. First portion 111*a* is configured with a flange 116 at each end such that second portion 111*b* slides between the flanges. In this manner, the sanitary door opener 100 can be adjusted to accommodate doors of varying depths.

In a second alternate embodiment of the present invention, the sanitary door opener is designed as a kick-plate. Referring now to FIG. 4, the sanitary door opener 200 comprises a bottom face 211, a rear face 212, a front face 213, a top face 214 and a lip 215. The rear face 212 is configured with a width approximating but not exceeding the width of a door. Preferably, the rear face has a width of about thirty inches (30"). The height of the rear face 212 can be the same as that of rear face 12 discussed in reference to FIG. 2. By providing a wide rear face, the rear face of the sanitary door opener also serves as a kick plate. Top face 214 can be the same width as the rear face or can be configured with a lesser width sufficient to provide a shoe grip to pull open the door. The front face 213 of the sanitary door opening can be configured to be of the same width as the rear face 212 or of a lesser width as desirable.

FIG. 5 shows the sanitary door opener 10 of the present invention installed on a typical public restroom door and in particular the engagement of a shoe within the top face 14/lip 15 arrangement to facilitate opening the restroom door.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A sanitary door opener adapted to be mounted to a door having a bottom edge, a front panel and a rear panel, said sanitary door opener comprising (a) a bottom face having a depth corresponding to the depth of said bottom edge of said door; (b) a front face; (c) a rear face; (d) a top face extending outwardly from said rear face at an angle of 90 or less, and (e) a lip extending downwardly at an angle of about 45° from said top face;

wherein, said sanitary door opener is installed onto a door by sliding said door opener under a door such that said bottom face contacts a bottom edge, said front face contacts a front panel and a rear face contacts said rear panel, and securing said front face to a front panel and said rear face to a rear panel.

2. The sanitary door opener in accordance with claim 1, wherein said sanitary door opener is manufactured from a single sheet of material.

3. The sanitary door opener in accordance with claim 1, wherein said top face and said lip are provided with a gripping material.

4. The sanitary door opener in accordance with claim 1, wherein said bottom face is comprised of a first portion joined to said rear face and a second portion joined to said front face, said first portion adapted to engage said second portion in such a manner that the depth of said bottom face is adjustable.

5. The sanitary door opener in accordance with claim 1, wherein said rear face is configured with a width which corresponds to the width of said rear panel, thereby conforming said rear face to a conventional kick plate.

6. A sanitary door opener adapted to be mounted to a door having a bottom edge, a front panel and a rear panel, said sanitary door opener comprising (a) a bottom face having a depth corresponding to the depth of said bottom edge of said door;

(b) a front face having a width between about six inches (6") and about twelve inches (12");

(c) a rear face having a width between about six inches (6") and about twelve inches (12");

(d) a top face extending outwardly from said rear face at an angle of 90 or less, said top face having a width of between about two inches (2") and about four inches (4"), and (e) a lip extending downwardly at an angle of about 45 from said top face, said lip having the same width as said top face;

wherein, said sanitary door opener is installed onto a door by sliding said door opener under a door such that said bottom face contacts a bottom edge of a door, said front face contacts a front panel of a door and said rear face contacts a rear panel of a door, and securing said front face to a front panel and said rear face to a rear panel.

7. The sanitary door opener in accordance with claim 6, wherein said sanitary door opener is manufactured from a single sheet of material.

8. The sanitary door opener in accordance with claim 6, wherein said top face and said lip are provided with a gripping material.

9. The sanitary door opener in accordance with claim 6, wherein said bottom face is comprised of a first portion joined to said rear face and a second portion joined to said front face, said first portion adapted to engage said second portion in such a manner that the depth of said bottom face is adjustable.

* * * * *